US005098368A

United States Patent [19]

Schmidt

[11] Patent Number: 5,098,368

[45] Date of Patent: Mar. 24, 1992

[54] CENTRIFUGAL APPARATUS

[75] Inventor: Paul Schmidt, Essen, Fed. Rep. of Germany

[73] Assignee: Kloeckner-Humboldt-Deutz Aktiengesellschaft, Fed. Rep. of Germany

[21] Appl. No.: 329,555

[22] Filed: Mar. 28, 1989

[30] Foreign Application Priority Data

Mar. 30, 1988 [DE] Fed. Rep. of Germany ..... 3810740
Feb. 22, 1989 [DE] Fed. Rep. of Germany ..... 3905341

[51] Int. Cl.[5] ..... B04B 3/06

[52] U.S. Cl. ..... 494/47; 494/43; 494/50; 494/56; 494/81; 210/360.1; 366/220; 366/184

[58] Field of Search ..... 494/43, 45, 46, 47, 494/50, 56, 81, 53, 66; 210/360.1, 369, 374; 134/104.1, 152; 366/220, 186, 187, 50, 184

[56] References Cited

U.S. PATENT DOCUMENTS

| | | | |
|---|---|---|---|
| 1,340,177 | 5/1920 | Miller | 494/53 |
| 1,509,099 | 9/1924 | Coleman | 494/47 |
| 2,136,540 | 11/1938 | Brock | 494/47 |
| 2,179,807 | 11/1939 | Asmussen | 494/45 |
| 2,553,936 | 5/1951 | Patrick | 494/66 |
| 2,565,246 | 8/1951 | Lehmkuhl | 134/152 |
| 2,718,353 | 9/1955 | Kelsey | 494/47 |
| 2,730,299 | 1/1956 | Kelsey | 494/47 |
| 4,474,478 | 10/1984 | DeLong | 366/186 |
| 4,664,527 | 5/1987 | Scholer | 366/186 |

FOREIGN PATENT DOCUMENTS

| | | |
|---|---|---|
| 1226862 | 10/1966 | Fed. Rep. of Germany . |
| 1296945 | 6/1969 | Fed. Rep. of Germany . |
| 3537662 | 4/1987 | Fed. Rep. of Germany . |

*Primary Examiner*—Harvey C. Hornsby
*Assistant Examiner*—Gary K. Graham
*Attorney, Agent, or Firm*—Hill, Van Santen, Steadman & Simpson

[57] ABSTRACT

A centrifugal apparatus including an annular shell of flexible material with annular end rings and means for driving the shell in rotation through the end rings, an external discharge roller in engagement with the outer surface of the shell and directing material toward a discharge nozzle within the shell with the nozzle leading outwardly for delivery of the material from the shell. In one form, the ends of the shell are connected to the rigid ends by rings of flexible material. An arrangement is provided for applying axial tension to the flexible material of the shell.

6 Claims, 3 Drawing Sheets

CENTRIFUGAL APPARATUS

BACKGROUND OF THE INVENTION

The present invention is directed to improvements in centrifuging apparatus such as used for dewatering, mixing, classifying, granulation or the like.

Centrifuging apparatus is used for the performance of various operations on materials such as where the materials must be separated or cleaned or otherwise treated under the influence of a relatively high centrifugal acceleration. By such centrifuges, greater forces can be applied to the material than that capable of being applied with the utilization of gravity.

It has been proposed to manufacture drums for centrifuging operation from nonrigid material such as rubber or textile structures wherein the structures are used in a rotating basket shell. One such proposal is illustrated in German Patent DP 1,226,862 which has no apparatus for charging or emptying the shell. Another proposal utilizes rubber vehicle tires as a basket shell.

For the purposes of emptying the shell, German Patent 1,296,945 provides a nozzle immersed in the rotating material within the shell. This proposal has the disadvantage that when a vehicle tire is used and is greatly deformed at the side wall, this heats the tire which ultimately fails. With constant operation which is desirable in the manufacturing process, a number of such tires each having a nozzle must be connected in series. This leads to substantial wear and cannot be utilized for many non-liquid substances.

A recent proposal provides a drum of flexible textile fabric. The discharge of goods occurs through a large number of openings in the shell, DE-OS 3,537,662. Difficulties in keeping the phases separated outside of the drum can occur. Further, the strength of the drum is weakened by the holes.

It is an object of the present invention to provide a continuously operating centrifugal apparatus with nonrigid walls wherein a surer discharge of the goods from the rotating drum occurs without disadvantageous wear or damage to the drum, to the materials being subjected to centrifuging, or to the discharge nozzle utilized for discharging the product.

A further object of the invention is to provide an improved structure for subjecting products handled therein to centrifugal action which avoids disadvantages of mechanisms heretofore available.

FEATURES OF THE INVENTION

In accordance with the principles of the invention, the above objectives are satisfied by providing a centrifugal apparatus wherein no contact between the basket shell and the nozzle occurs so that they cannot damage one another.

Further, the materials will enter a discharge nozzle without damage to a rotating shell or to the nozzle.

Further, a flexible shell is used and is maintained under axial tension and additionally is maintained under circumferential tension because of the relatively high circumferential speed. This also reduces damage to the nozzle and reduces the structural costs of the mechanism.

Other objects, advantages and features will become more apparent with the teaching of the principles of the invention in connection with the disclosure of the preferred embodiment in the specification, claims and drawings, in which:

DESCRIPTION OF THE PREFERRED EMBODIMENTS

Figure 1:
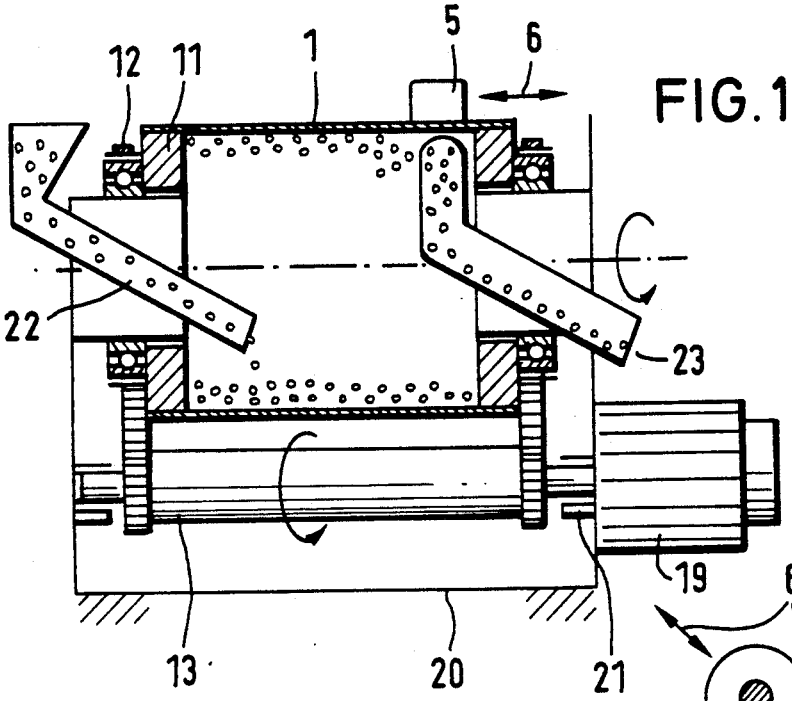
FIG. 1 is a vertical sectional view taken through a structure constructed and operating in accordance with the principles of the present invention.

FIG. 1 illustrates a cylindrical basket shell 1 formed of a flexible material. Various materials may be employed for the shell such as having the shell fashioned as a one-piece annular band. Or, the shell may be formed of a helical band formed and laminated. It can also be comprised of a tightly laid fabric such as braided fabric and can include a calendered surface.

The flexible basket shell is supported on end rings 11 which are carried on bearings. For driving the shell in rotation, a toothed belt 12 may be arranged to drive shell. In another form of driving, a drive motor 19 may drive a shaft 13 through a connecting mechanism 21 to drive gears for driving pinions connected to the end rings 11.

In engagement with the outer surface of the flexible shell 1 are rollers 2 which are positioned to guide material being centrifuged therein to a discharge nozzle 3. The material is shown entering the discharge nozzle at 4 in FIG. 2.

Material is directed into the shell 1 through an admission conduit 22.

A discharge roller 5 is in engagement with the outer surface of the shell and functions to help direct the material to the discharge nozzle 3. For this purpose, the roller 5 is adjustable as shown by the arrowed lines in adjustment region 6.

Figure 2:
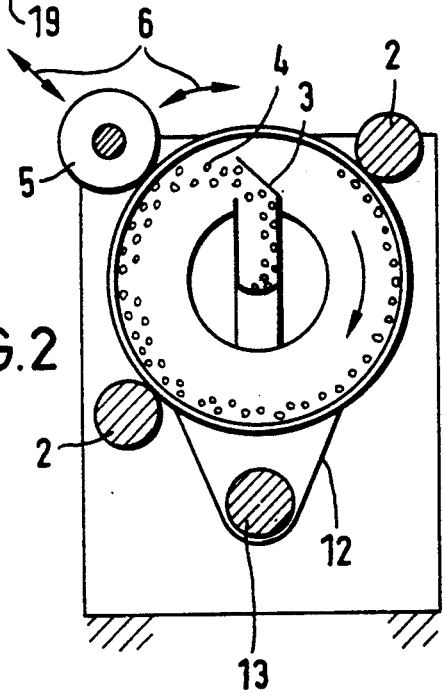
FIG. 2 is a vertical sectional view taken through the axis of the mechanism shown in FIG. 1.
Figure 3:
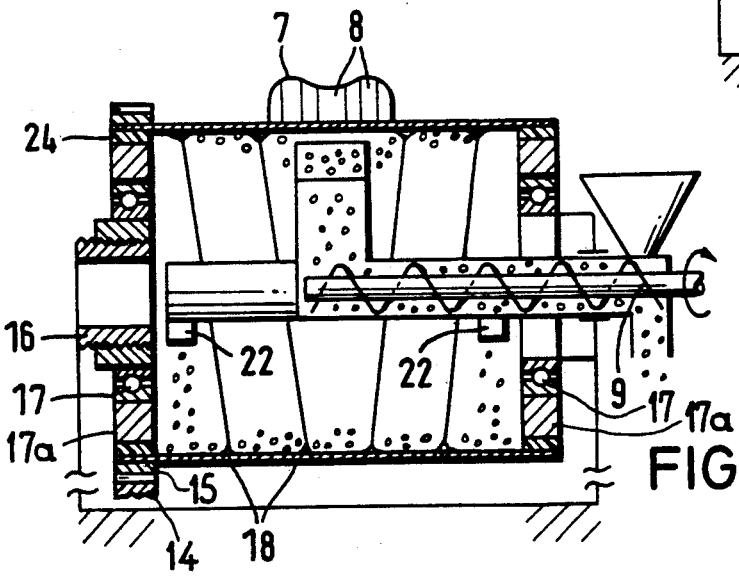
FIG. 3 is a vertical sectional view similar to FIG. 1 but illustrating a modified form of the invention.
Figure 4:
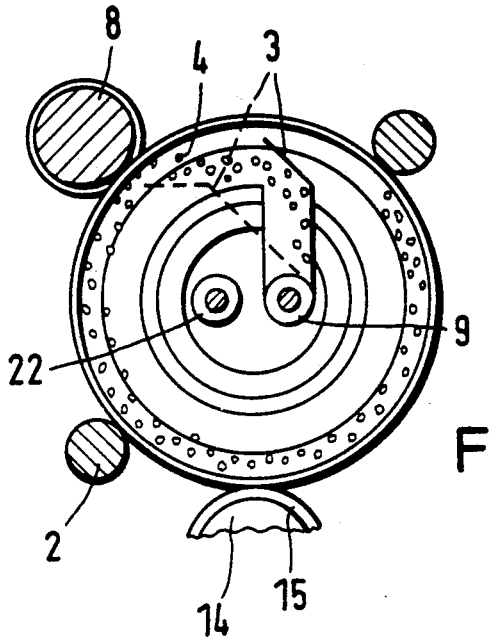
FIG. 4 is a vertical sectional view taken through the center of the structure of FIG. 3.

As illustrated in FIG. 3, another embodiment has a discharge roller 7 constructed of plate elements 8 in engagement with the outer surface of the shell. The discharge roller is shown as grooved and directs material within toward a discharge nozzle 3, FIG. 4, within the shell. Parts similar to the arrangement in FIGS. 1 and 2 are similarly numbered, and 22 indicates a product admission conduit. 14 and 15, FIG. 4, show a drive gearing for driving the shell in rotation and the shell has end plates 17*a* mounted on suitable bearings 17 for rotation of the shell.

Within the shell are helical webs 18 which tend to direct the flow of material in the shell toward the center to pass out through the discharge nozzle, which in the case of FIG. 3, is provided with a worm conveyor 9 leading to a downwardly extending conduit from the inside of the shell to the outside.

The discharge roller 7 is grooved toward the center.. and constructed of plate elements 8 which extend circumferentially and are clamped together axially and located in a position to engage the outer surface of the rotating shell.

The shell in this case is shown attached to the end rings by elastic rings 24. The end rings are mounted in bearings for rotation of the shell and a stationary hub 16 is arranged with threads so that this provides an axial tensioning mechanism for the shell. Adjustment of the threaded ring which carries the bearings for the end ring will apply an axial force to the shell to maintain it under the desired axial tension.

Figure 5:
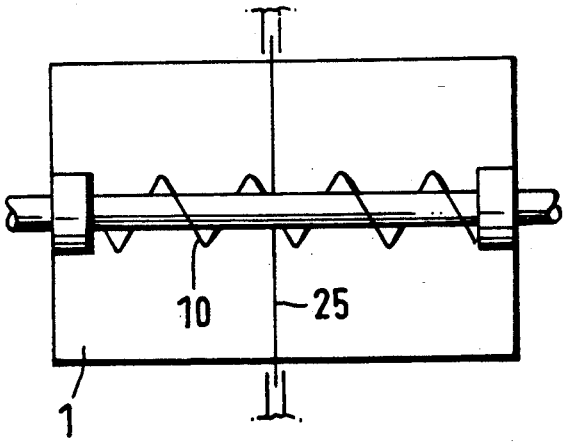
FIG. 5 is a somewhat schematic illustration showing a modified form of the invention.

FIG. 5, which is shown in somewhat schematic form, illustrates the shell 1 with a circumferential ring at 25 lending strength to the flexible shell and with a helical flight 10 therein for advancing material within the shell. FIG. 5 is shown to illustrate a structure for moving material in a shell for strengthening a shell such as shown by the shell illustrated in others Figures.

Figure 6:
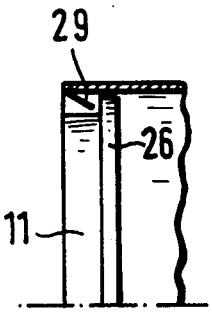
FIG. 6 is an enlarged fragmentary sectional view illustrating structural relationships between the flexible shell and an end plate for the shell.

FIG. 6 illustrates a detail for end rings 11. The outer shell has a tensioning rim 26 coacting with spreader ring elements 29 attached to the ends of the basket shell for the purposes of applying an axial tension to the shell. As will be apparent from the drawing, the rim 26 has means, not shown, to pull it axially to the left thus pulling axially on the end ring elements 29 to axially tension the shell.

Figure 7:
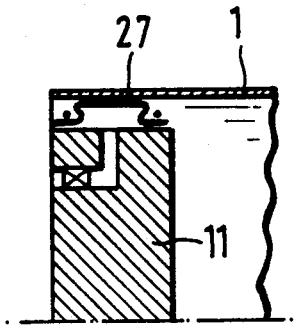
FIG. 7 is another view showing a structural relationship between a flexible shell and an end plate for the shell of a modified arrangement.

FIG. 7 illustrates another arrangement wherein a flexible shell 1 has rim rings 11 having an annular inflatable ring 27 of elastic material which, when inflated, provides a reliable connection between the shell and the rim rings.

Figure 8:
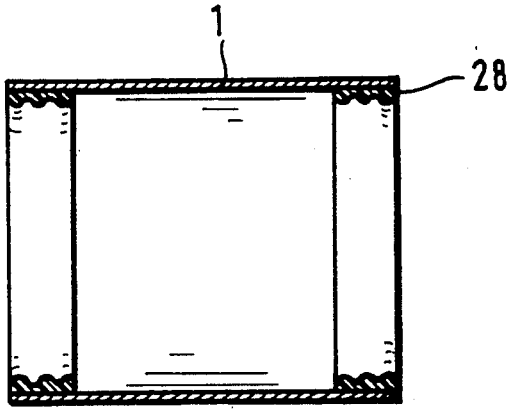
FIG. 8 is another somewhat schematic vertical sectional view illustrating another form of structure of the invention.

In the illustration of FIG. 8 which is shown somewhat schematically, the shell 1 has a ring 28 of elastic material which has an inside thread for better attachment to the end plates.

Figure 9:
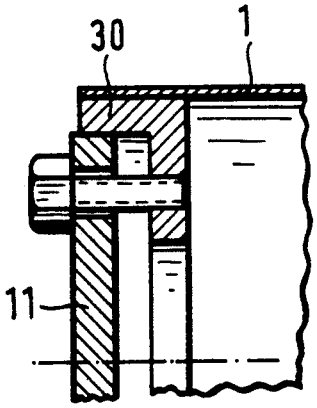
FIG. 9 is an enlarged fragmentary sectional view illustrating one end of the shell.

In FIG. 9, a form of axial tensioning mechanism is shown. The flexible shell 1 is secured to annular end rings 30 at its ends. The rings have spaced threaded holes which receive bolts that pass through end plates 11. Tightening of the bolts will cause the rings 30 to apply an axial tension to the shell 1.

Figure 10:
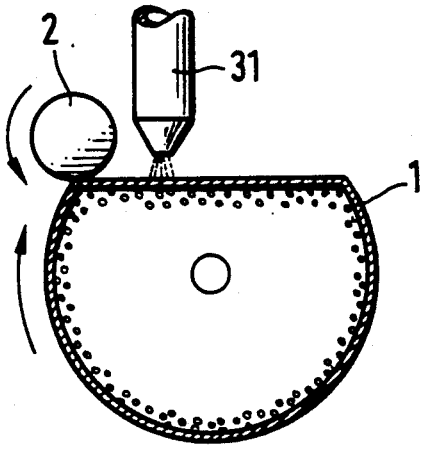
FIG. 10 is a schematic vertical sectional view illustrating a structure for cleaning the shell.

In FIG. 10, a cleaning jet 31 is shown for delivering a cleaning fluid from the outside through the flexible basket shell 1 which is pressed inwardly by a roller 2. This for a cleaning operation, will cause a fluid under pressure to be directed against the surface of the flexible material 1 and the flexing of the material will provide an improved cleaning operation. The shell 1 will flex due to the force of the roller and the pressure of the jet and while the flexure is shown schematically, it will be appreciated by those versed in the art that the actual flexure or distortion will be a function of the forces of the roller and jet.

In accordance with the principles of the invention, one form of structure practicing the invention may exert a centrifugal acceleration due to rotation of the shell of between 100 through 1000 $m/g^2$. The diameter of the basket shell will be chosen between 0.2 through 1.0 m. Drive power is employed in an amount ranging from 1 through 10 kW. The centrifugal device may be used for subjecting to centrifugal action, granules, sands, sewage sludges, crystallized products, suspension and the like.

Thus, it will be seen I have provided an improved structure which meets the objectives and advantages above set forth and provides for improvements in centrifugal operation over devices heretofore available.

I claim as my invention:

1. A centrifuging apparatus used for dewatering, mixing or classifying comprising in combination:

a cylindrical shell of porous flexible material having a cylindrical inner surface and a cylindrical outer surface;

rigid end plates supporting the shell for rotation;

means for driving the shell in rotation;

an inlet means for delivering a product to the shell for centrifugal action;

a discharge nozzle spaced axially from said inlet means and leading from the shell, said nozzle having an inlet positioned internally of the shell in non-touching adjacency relative to the inner surface of the shell to receive a product moving along within the shell;

means for deflecting the shell to fluidize the product therein so that the product flows axially along the cylindrical inner surface from the inlet means to the discharge inlet;

said means for deflecting comprising a discharge roller in engagement with the external surface of the shell closely in advance of said nozzle inlet compressing the shell and aiding in movement of the product into the nozzle inlet so that the product continues to move into the nozzle to be dispersed from the shell;

one of said end plates being supported on a rotatable bearing element;

the bearing element being adjustable in an axial direction for controlling the axial tension in the shell.

2. A centrifuging apparatus used for dewatering, mixing or classifying comprising in combination:

a cylindrical shell of porous flexible material having a cylindrical inner surface and a cylindrical outer surface;

means for driving the shell in rotation;

an inlet means for delivering a product to the shell for centrifugal action;

a discharge nozzle spaced axially from said inlet means and leading from the shell, said nozzle having an inlet positioned internally of the shell in non-touching adjacency relative to the inner surface of the shell to receive a product moving along within the shell;

means for deflecting the shell to fluidize the product therein so that the product flows axially along the cylindrical inner surface from the inlet means to the discharge inlet;

said means for deflecting comprising a discharge roller in engagement with the external surface of the shell closely in advance of said nozzle inlet compressing the shell and aiding in movement of the product into the nozzle inlet so that the product continues to move into the nozzle to be dispersed from the shell;

and means for applying an axial tensioning force to the flexible shell.

3. A centrifuging apparatus used for dewatering, mixing or classifying comprising in combination:

a cylindrical shell of flexible material;

means for applying an axial tension to the shell aiding in retaining the cylindrical shell shape;

means for driving the shell in rotation;

means for delivering a product to the interior of the shell to be subjected to centrifugal action;

and a discharge conduit leading from the shell having an inlet positioned internally of the shell to receive a product moving along within the shell.

4. A centrifuging apparatus used for dewatering, mixing or classifying constructed in accordance with claim 3:

including at least one roller in engagement with the outer surface of the flexible shell flexing the material of the shell to aid in movement of the material within the shell.

5. A centrifuging apparatus used for dewatering, mixing or classifying constructed in accordance with claim 3:

including conveying means within the conduit.

6. A centrifuging apparatus used for dewatering, mixing or classifying constructed in accordance with claim 3:

wherein said conveying means is a screw auger.

* * * * *